US007575283B2

(12) United States Patent
Crowe

(10) Patent No.: US 7,575,283 B2
(45) Date of Patent: Aug. 18, 2009

(54) MODULAR BOOTH SEAT

(75) Inventor: Scott D. Crowe, Roseburg, OR (US)

(73) Assignee: FCC Commercial Furniture, Inc., Roseburg, OR (US)

( * ) Notice: Subject to any disclaimer, the term of this patent is extended or adjusted under 35 U.S.C. 154(b) by 0 days.

(21) Appl. No.: 12/001,506

(22) Filed: Dec. 11, 2007

(65) Prior Publication Data

US 2008/0164742 A1 Jul. 10, 2008

(51) Int. Cl.
*A47C 7/02* (2006.01)
*A47B 83/02* (2006.01)

(52) U.S. Cl. ..... 297/440.1; 297/440.15; 297/440.16; 297/440.2; 297/440.21; 297/440.22; 297/162; 297/158.1

(58) Field of Classification Search ..... 297/440.1, 297/440.14, 440.15, 440.16, 440.2, 440.21, 297/440.22, 182, 158.1
See application file for complete search history.

(56) References Cited

U.S. PATENT DOCUMENTS 860,632 A * 7/1907 Breithut ..... 297/440.2
1,251,714 A * 1/1918 Walton ..... 297/440.15 X
1,542,770 A * 6/1925 Hess ..... 297/440.1
1,598,468 A * 8/1926 Whall ..... 297/440.15 X
1,692,252 A * 11/1928 Eichman ..... 297/440.2 X
1,769,242 A * 7/1930 Toncray ..... 297/440.16 X
2,016,133 A * 10/1935 Chandler ..... 297/440.15 X
2,021,120 A * 11/1935 Wilkins ..... 297/440.15 X
2,047,682 A * 7/1936 Grinnell ..... 297/440.15 X
2,260,981 A * 10/1941 Shanahan ..... 297/440.15 X
2,261,506 A * 11/1941 Scott ..... 297/244
2,400,167 A * 5/1946 Resnick ..... 297/182
2,786,513 A * 3/1957 Hoven et al. ..... 297/440.15 X
3,093,410 A * 6/1963 Wilson ..... 297/440.21 X
3,099,482 A * 7/1963 Woodruff, Sr. ..... 297/440.15 X
3,171,685 A * 3/1965 Hershberger et al. .. 297/440.2 X
3,704,911 A * 12/1972 Milakovich ..... 297/440.16
3,866,974 A * 2/1975 Jones ..... 297/158.1 X
3,885,830 A * 5/1975 Jones ..... 297/440.15 X
3,939,987 A * 2/1976 Bustos et al. ..... 211/134
3,989,300 A * 11/1976 Heumann ..... 297/440.22
4,032,188 A * 6/1977 Jones ..... 297/440.21 X
4,077,665 A * 3/1978 Storch ..... 297/244
4,169,628 A * 10/1979 Wolf et al. ..... 297/452.12
4,395,071 A * 7/1983 Laird ..... 297/440.21
4,488,755 A * 12/1984 Nemschoff ..... 297/440.21
4,717,202 A * 1/1988 Batchelder et al. ..... 297/188.04
4,844,541 A * 7/1989 Laird ..... 297/440.21 X
4,850,642 A * 7/1989 Crowe ..... 297/452.18
4,949,929 A * 8/1990 Kesselman et al. ..... 248/300
5,000,512 A * 3/1991 Laird ..... 297/440.1
5,069,506 A * 12/1991 Wieland ..... 297/440.15
5,112,110 A * 5/1992 Perkins ..... 297/440.21
5,135,284 A * 8/1992 Crum ..... 297/440.15
5,291,643 A * 3/1994 Boeglin ..... 297/440.1 X
5,352,017 A * 10/1994 Berning ..... 297/440.1 X
5,451,092 A * 9/1995 Gray ..... 297/440.1 X
5,865,508 A * 2/1999 Martin ..... 297/440.15 X (Continued)

*Primary Examiner*—Rodney B White

(57) ABSTRACT

Modular seating sections can be joined to form booth seating that can easily be reconfigured or reupholstered. The seat sections include a generally vertical back element having a lower edge that is connected to the inner edge of a generally horizontal seat section. A gusset extends diagonally between the back section and the seat section to add rigidity and strength.

20 Claims, 8 Drawing Sheets

U.S. PATENT DOCUMENTS 6,135,562 A * 10/2000 Infanti ..... 297/440.2
6,994,402 B1 * 2/2006 Dodge ..... 297/440.15 X
7,066,548 B2 * 6/2006 Butler ..... 297/440.1
7,255,403 B2 * 8/2007 Butler ..... 297/440.1
7,399,036 B2 * 7/2008 Kowal et al. ..... 297/440.16
2003/0146653 A1 * 8/2003 Butler ..... 297/440.1
2005/0151409 A1 * 7/2005 Infanti et al. ..... 297/440.2
2006/0186722 A1 * 8/2006 Butler ..... 297/440.1

* cited by examiner 10
12
14
16
18
20
24
26
28
30
34
36
38
46
48
58
60
62
62a
64
66
68
70
72
82
84
86
87
88
89
90

MODULAR BOOTH SEAT

BACKGROUND OF THE INVENTION

Restaurants commonly use booth seating because it separates diners and is more intimate. The prior art booth seats have generally been constructed from scratch on site or constructed as stand-alone units in a factory. As a result, if the restaurant wants to change its seating arrangement, it must either make the existing booth seating work or obtain entirely new booth seating. In addition, with the existing booth seating even reupholstering requires extensive disassembly of the booth and the resulting time during which the restaurant must be closed. Thus, booth seating is expensive to modify once it is in place.

BRIEF SUMMARY OF THE INVENTION

The subject invention provides modular booth seating sections which can be interconnected on site which enables them to be moved or reupholstered easily. This is accomplished by providing a generally vertical back section which is connected at its bottom edge to the inner edge of a generally horizontal seat element. A gusset plate has a front leg that is attached to the back element and a second leg that is attached to the seat element.

The foregoing and other objectives, features, and advantages of the invention will be more readily understood upon consideration of the following detailed description of the invention, taken in conjunction with the accompanying drawings.

DETAILED DESCRIPTION OF PREFERRED EMBODIMENT

Figure 1:
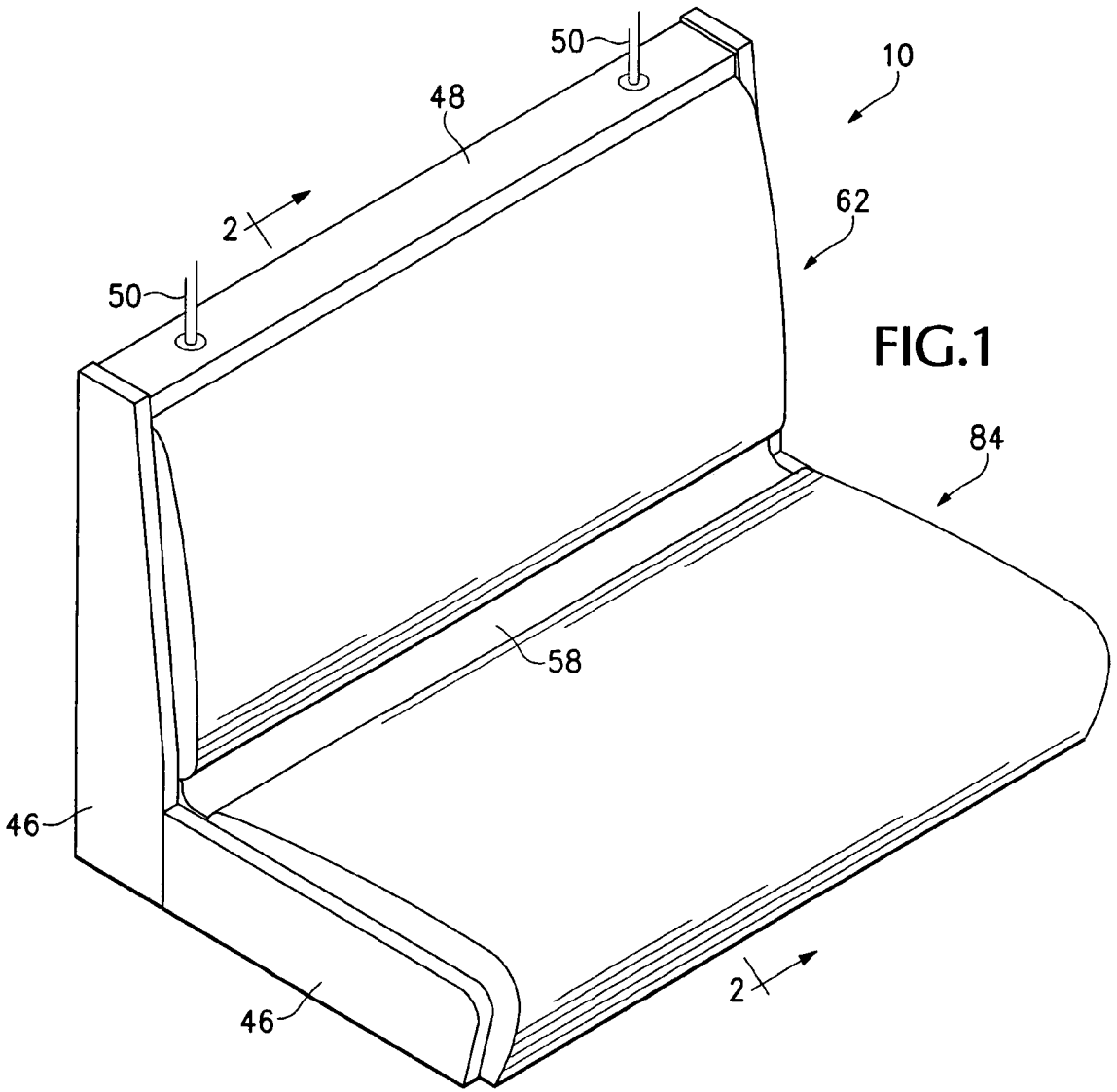
FIG. 1 is a perspective view showing a modular booth seat section embodying the subject invention.
Figures 2, 3, 4:
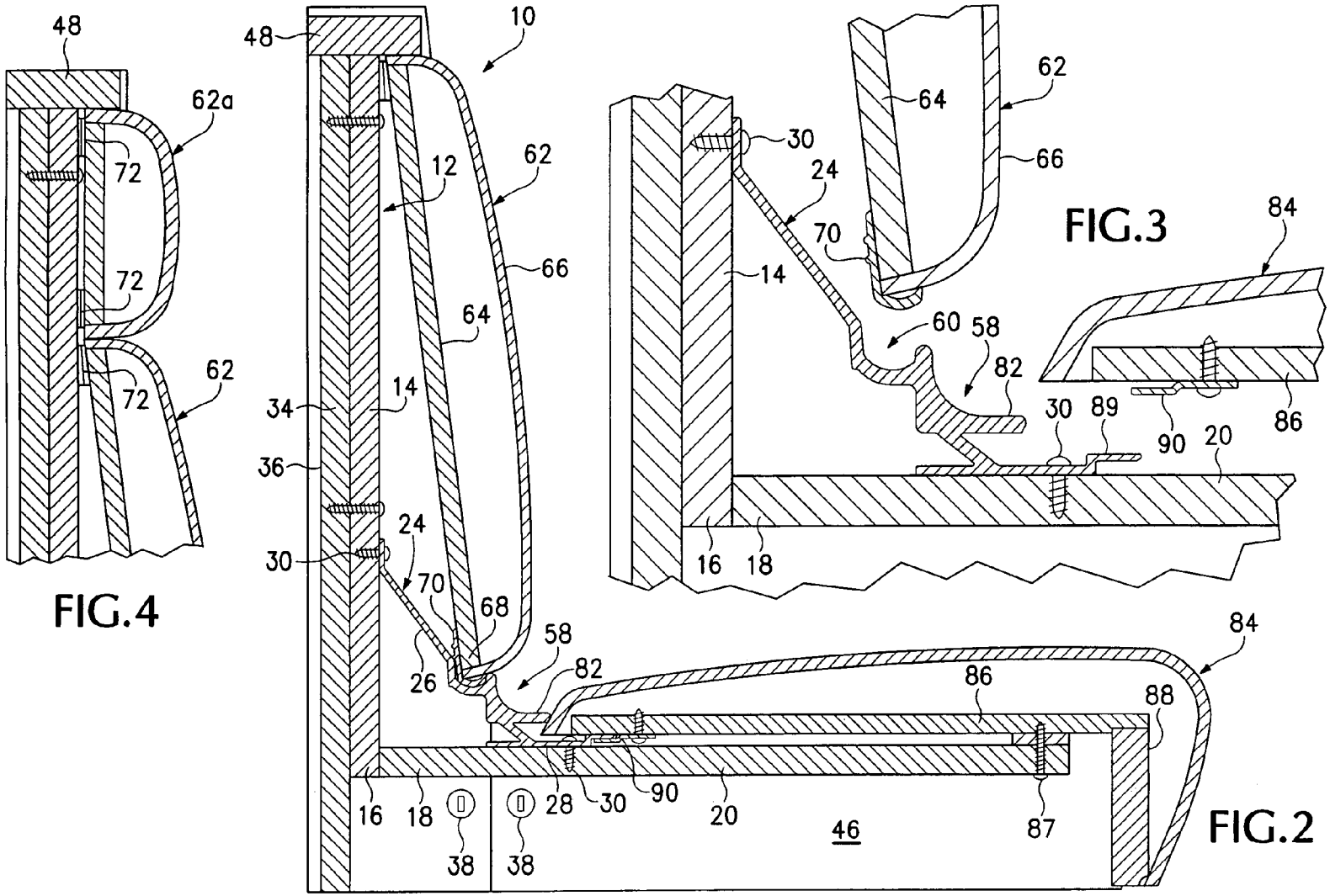
FIG. 2 is a sectional view taken along the lines 2-2 in FIG. 1.
FIG. 3 is a fragmentary cross-sectional exploded view of a portion of the seat section shown in FIG. 2.
FIG. 4 is a fragmentary cross-section view similar to FIG. 2 showing an alternative embodiment.
Figure 5:
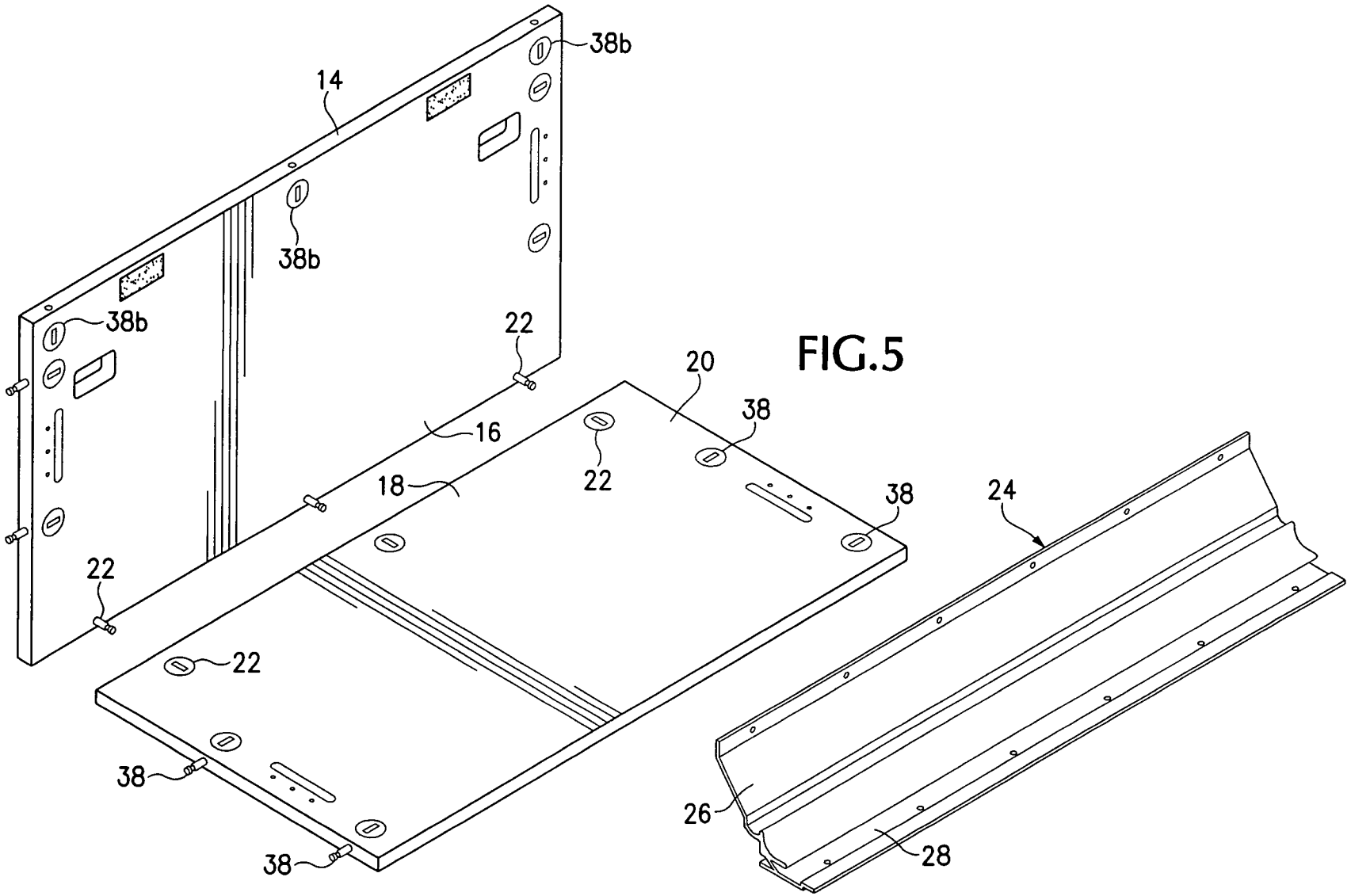
FIG. 5 is an exploded perspective view showing the elements of the invention.

Referring to FIGS. 1-5 of the attached drawing, a modular booth seat section 10 has a subframe 12 including a rectangular back element 14 which is attached along its lower edge 16 to the inner edge 18 of a planar rectangular seat element 20. The back and seat elements are made from rigid panels, such as plywood. In the embodiment illustrated the back element 14 is generally vertical and the seat element 20 is generally horizontal. The back and seat elements are joined to each other by conventional fasteners. In the embodiment illustrated, the fasteners are double cam and stud connectors 22 which are commonly used in knock-down furniture construction.

An elongate gusset plate 24, which extends diagonally across the intersection of the back and seat elements, has a first leg 26 which is attached to the back element 14, and a second leg 28 which is attached to the seat element 20. In the embodiment illustrated the gusset plate 24 is attached to the subframe elements 14, 20 by screws 30, but other types of fasteners could be utilized. Once joined, the two subframe elements and the gusset plate form a box frame which creates a unitary subframe that is rigid and can withstand normal loads applied to a seat of this type. The gusset plate preferably is an aluminum extrusion, but it could be made of other materials and it could be cast or molded. The subframe 12 rests on a metal or wood support (not shown). A planar rectangular back support 34 having a decorative facing 36 can be attached to the back element to provide a finished surface when the booth back is exposed.

Figures 6, 7, 8:
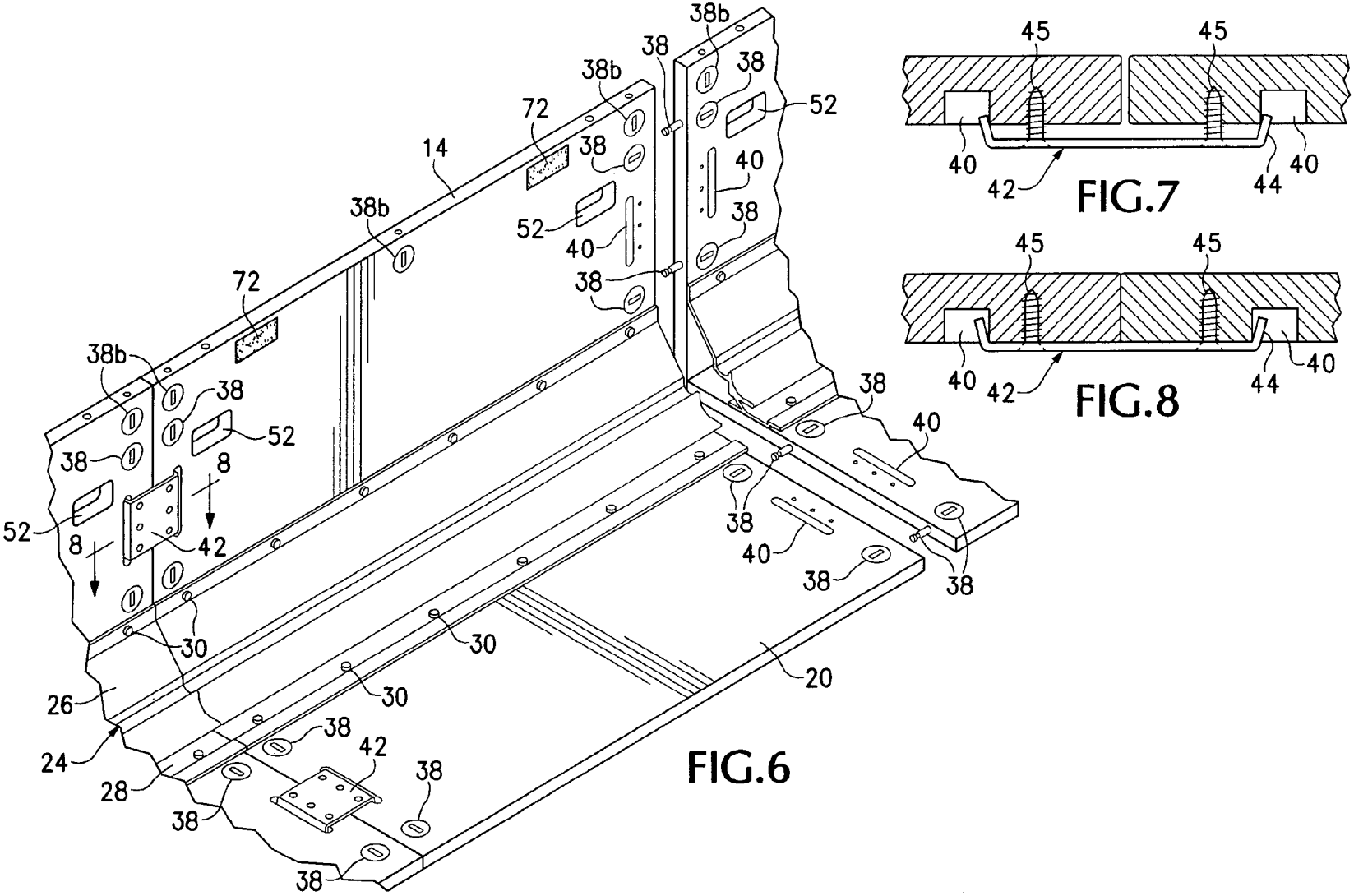
FIG. 6 is a foreshortened perspective view showing the elements assembled.
FIGS. 7 and 8 are cross-sectional views showing details of a clamp plate which is an element of the subject invention.

The length of the subframe elements 14, 20 varies depending on the particular application. However, they are meant to be modular sections with multiple subframe sections being joined end to end to create a complete booth. Referring now to FIGS. 6-8, side-by-side subframe sections are joined together by stud cam fasteners 38 similar to the fasteners 22 used to join the back and seat elements together. In order to provide greater strength between adjacent modules, slots 40 are placed in the ends of the back and seat elements 14, 20 and clamp plates 42, having opposed legs 44 which fit into aligned slots 40 in adjacent subframe elements, are attached to the subframe elements. The legs 44 are angled outwardly as they extend inwardly toward the subframe elements such that they pull adjacent modular sections toward one another as the screws 45 which attach them to the back and seat elements are tightened.

Figure 10:
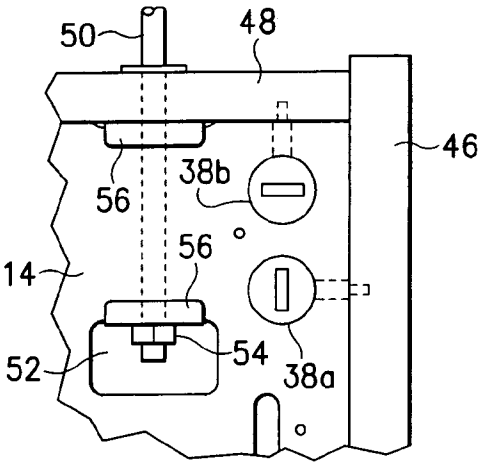
FIG. 10 is a side view showing the details of attaching the top and end pieces.
Figure 9:
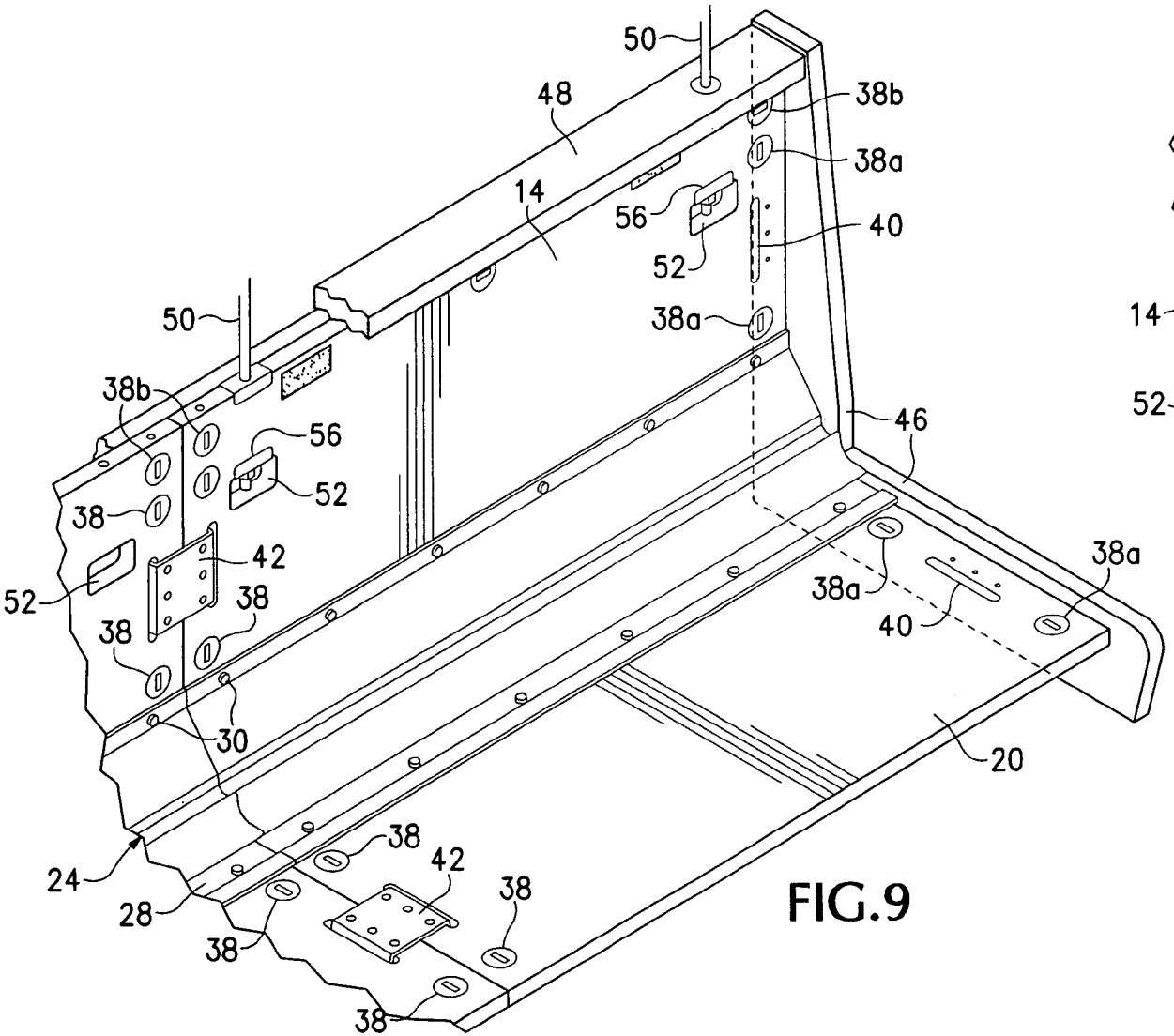
FIG. 9 is a fragmentary cross-sectional view similar to FIG. 6 showing the installation of top and end pieces.

If desired, exposed ends of the end module in each booth can be covered by end pieces 46. The end pieces are attached to the back and seat elements 14, 20 by post and cam fasteners 38*a*. The top of the completed booth is covered by a top piece 48. The top piece is attached to the back element 14 by post and cam fasteners 38*b*. Posts 50 extend upwardly through the upper end of the back element and top piece 48 to allow a privacy screen (not shown) to be mounted on top of the top piece. Referring now to FIG. 10, the bottom ends of posts 50 extend into openings 52 in the back element and are threaded. Nuts 54 placed on the threaded portions of the posts hold them in place if they are used and allow them to be removed if they are not used. The posts extend through aligned holes in C-shaped plates 56 located on the top edge of the back element and the top of the openings 52 to protect the back element.

The gusset plate 24 has a curved center section 58 which is substantially vertical at one end and substantially horizontal at the other end. The center section acts as a crumb catcher, as will be more fully explained later. Located immediately above the center section 58 is a cup section 60 which receives the bottom end of a seat back 62. The seat back 62 can either have a solid surface, FIGS. 2-4, or be upholstered, FIGS. 14 and 15. The solid surface seat back has a planar rectangular back 64, which preferably is plywood. A rigid plastic or fiberglass shell 66 is adhered to the base with an adhesive. Attached to the lower edge 68 of the seat back is a bull nose 70 which has an outer surface which fits into the cup section 60 of the gusset plate 24. The bull nose is made from a slightly deformable material such as a plastic resin. The upper end of the seat back is removably attached to the back element 14 by strips of hook and loop fastener 72. If desired the seat back 62 can be in two or even three sections, with a top section 62*a* being attached to the back element 14 entirely by hook and loop fasteners, FIG. 4.

Figure 14:
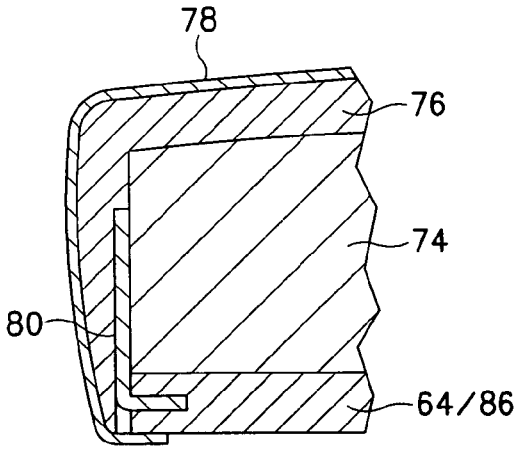
FIG. 14 is a fragmentary cross-sectional view taken along the lines 14-14 in FIG. 13.
Figure 15:
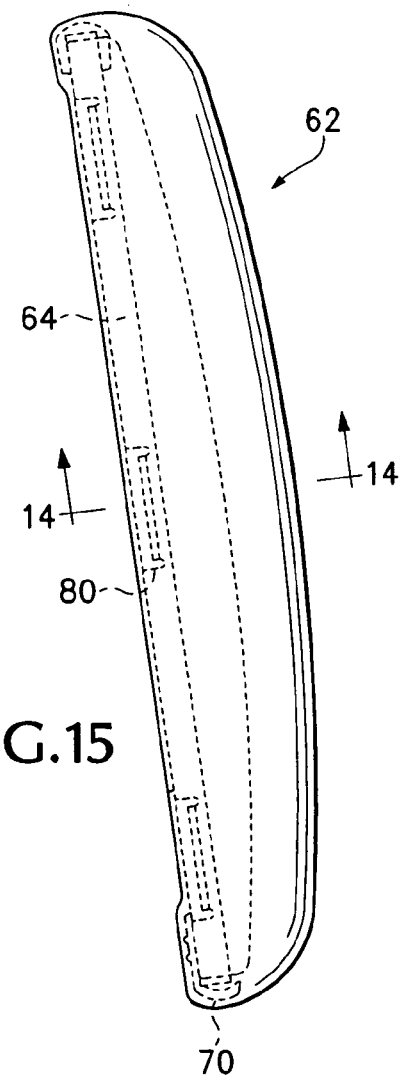
FIG. 15 is an end elevational view of an upholstered back section.

Referring now to FIGS. 14 and 15, if the seat back is upholstered it uses the same back 64 as the hard surface seat back. In the embodiment illustrated the back 64 is first covered with a layer of foam 74, then a thin layer of batting 76 and finally with the upholstery material 78. A metal angle plate 80 which is attached to the seat back 64 protects the ends of the foam layer. The upholstery back is mounted on the subframe in the same manner as the rigid surface back and can also be one, two or three pieces.

Figure 13:
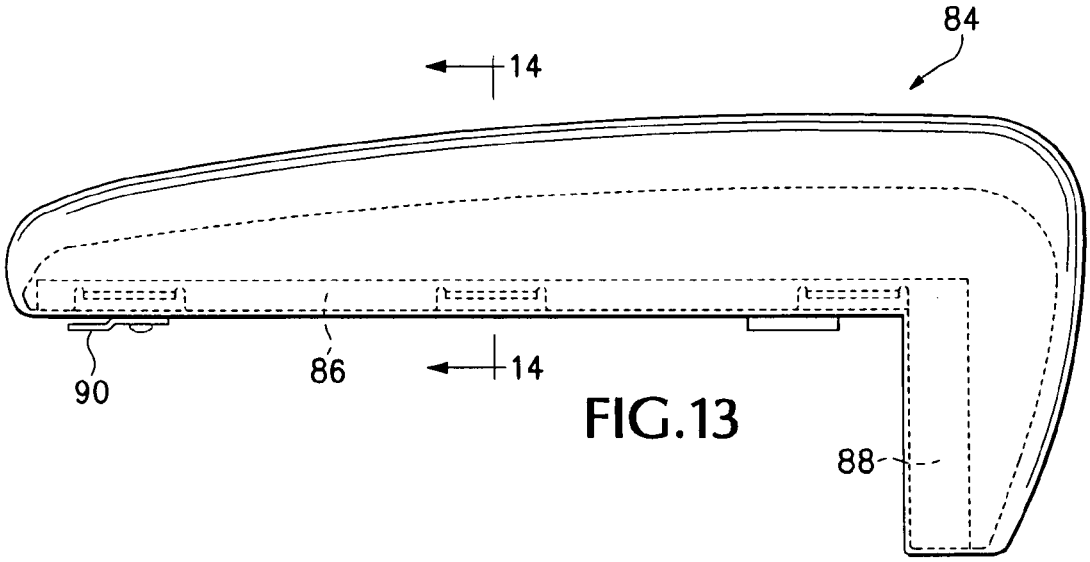
FIG. 13 is an end elevational view of an upholstered seat.

Located in front of the center section 58 of the gusset plate 24 is a lip 82 which receives the inner end of a seat bottom 84. Like seat back 62 the seat bottom can have a solid surface, FIGS. 2 and 3, or be upholstered, FIGS. 13 and 14. The upholstered seat bottom 84 is constructed similarly to the upholstered seat back 62. In either case the seat bottom has a planar rectangular seat base 86 which preferably also is plywood. The seat base 86 is attached to a kick plate 88 which extends to the lower edge of the seat bottom 84. The inner end of the seat bottom 84 fits under the lip 82 in the gusset plate 24. The outer end of the seat bottom 84 is attached to the seat element 20 of the subframe 12 by screws 87. A tang 89 formed in the front edge of the gusset plate 24 receives a clip 90 attached to the seat base 86 to hold the inner edge of the seat bottom 84 in place.

Figure 11:
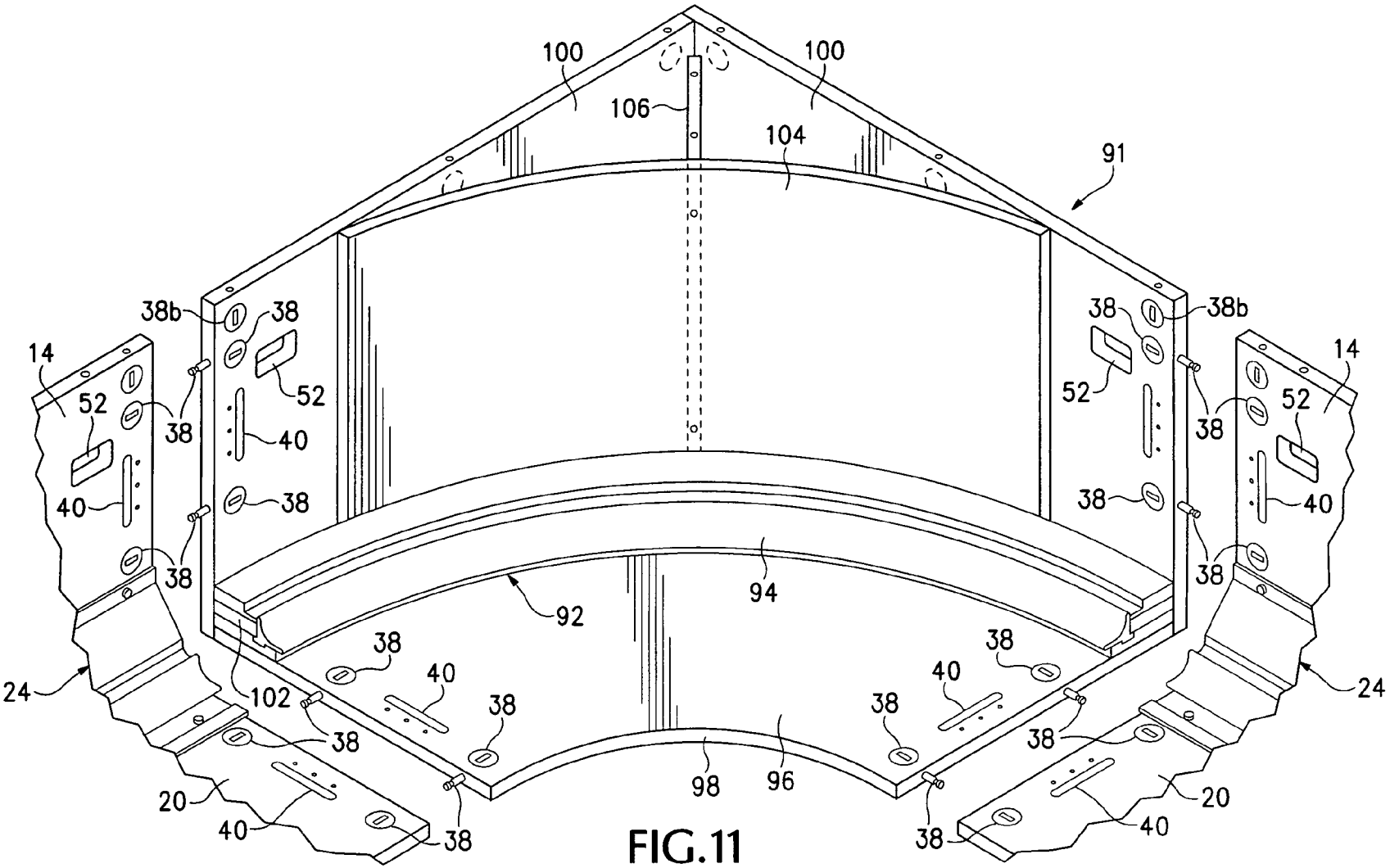
FIG. 11 is a perspective view showing the components of a corner element.
Figure 12:
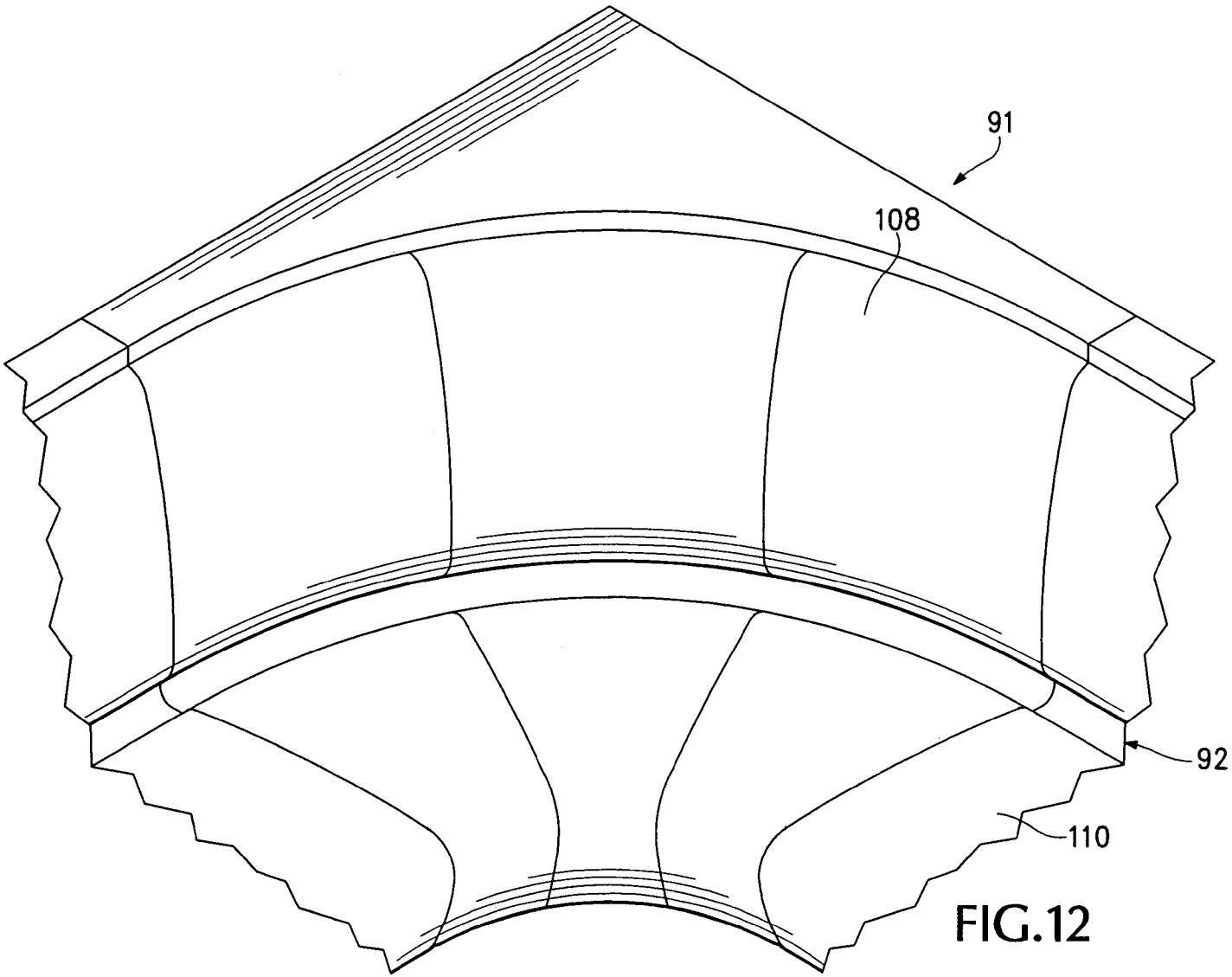
FIG. 12 is a foreshortened perspective view of the corner element of FIG. 12 completed.

Referring now to FIGS. 11 and 12, the gusset plate 24 is too stiff to bend to form a rounded corner in a booth. A corner unit 91 contains a crumb catcher 92 having a curved surface which matches that of the center section 58. The crumb catcher preferably is extruded aluminum but, unlike the gusset plate, has a cross-section that allows it to be bent. The crumb catcher is attached to a subframe seat base panel 96 which has a curved outer edge 98. The crumb catcher is embedded in and attached to a stack of curved wood pieces 102 which are attached to the base panel 96. Back pieces 100, which are configured to mate with the back elements 14 on the seat modules on each side of the corner unit, are attached to the wood pieces 102 to join the base panel 96, crumb catcher 92 and back pieces 100 into an integral structure. A curved corner panel 104 extends between the two back pieces 100 and a stiffener 106 extends between the center of the corner panel 104 and the intersection of the back pieces 100. The floor section 96, back sections 100, corner panel 104, and stiffener 106 are all preferably made from plywood and are joined to one another with cam and stud fasteners. The outside edges of the back pieces 100 are joined to the abutting back elements 14 and the outside edges of the floor section 96 are joined to the abutting seat elements 20 by stud and cam fasteners 38. Because the gusset plate does not extend around the corner unit the seat back 108 and seat 110 base are attached to the corner unit by conventional means.

The terms and expressions which have been employed in the foregoing specification are used therein as terms of description and not of limitation, and there is no intention, in the use of such terms and expressions, of excluding equivalents of the features shown and described or portions thereof, it being recognized that the scope of the invention is defined and limited only by the claims which follow.

I claim:

1. A modular booth seat section comprising:

(a) a generally vertical back element having a lower edge;

(b) a generally horizontal seat element having an inner edge, said lower edge of said back element intersecting with said inner edge of said seat element; and (c) a gusset plate having a first leg which is attached to said back element and a second leg which is attached to said seat element: wherein (d) said gusset plate has a medial portion which extends between said first and second legs diagonally across the intersection of said lower edge of said back element and said inner edge of said seat element.

2. A modular booth seat section comprising:

(a) a generally vertical back element having a lower edge;

(b) a generally horizontal seat element having an inner edge, said lower edge of said back element intersecting with said inner edge of said seat element;

(c) a gusset plate having a first leg which is attached to said back element and a second leg which is attached to said seat element; wherein (d) said back element and said seat element have substantially the same length and said gusset plate extends substantially across said length.

3. The seat section of claims 1 or 2 wherein said gusset plate includes a center section which catches crumbs dropped by diners seated on said seat section.

4. The seat section of claim 2 wherein said center section is substantially vertical on a first side and substantially horizontal on a second side.

5. The seat section claims 1 or 2 including a seat back engagement mechanism for releasably attaching a seat back to said back element.

6. The seat section of claim 5 wherein said seat section includes a seat back and said seat back engagement mechanism includes:

(a) an upwardly opening cup located medially on said gusset; and (b) said seat back has a lower edge which is configured to fit into said cup when said seat back is placed against said back element.

7. The seat section of claim 6 wherein said lower edge is a slightly deformable bullnose.

8. The seat section of claim 7 wherein said bullnose is made from a soft plastic material.

9. The seat section of claim 6 wherein said seat back engagement mechanism further includes a fastener having a first fastener element which is attached to an upper edge of said seat back and a second fastener element that cooperates with said first fastener element and is attached to said back element.

10. The seat section of claim 9 wherein said fastener is a hook and loop fastener.

11. The seat section of claim 1 or 2 including a seat bottom engagement mechanism for releasably attaching a seat bottom to said seat section.

12. The seat section of claim 11 wherein said seat section includes a seat bottom and a seat bottom engagement mechanism comprises:

(a) an outwardly facing lip which is located medially on said gusset; and (b) said seat bottom has an inner end which fits under said lip when said seat bottom is placed against said seat element.

13. The seat section of claim 11 wherein said seat section includes a seat bottom and said seat bottom engagement mechanism comprises:

(a) an outwardly facing tang which is located medially on said gusset; and (b) an inwardly facing clip which is attached to an underside of said seat bottom and engages said tang when said seat bottom is placed against said seat element.

14. A booth seat comprising of multiple seat sections of claim 1 joined end to end.

15. The booth seat of claim 14 wherein adjacent seat sections are joined by cam fasteners.

16. The booth seat of claim 14 wherein adjacent seat sections are joined by a clamp mechanism comprising:

(a) slots located along side margins of said seat elements and said seat back elements;

(b) a clamp plate having bent edges, said clamp plate being configured such that one of said edges fits into a slot and one of said seat element or back element and another of said edges fits into a slot in an adjacent one of said seat element or back element, wherein said clamp plate is placed across the abutting edges of adjacent seat elements or back elements; and (c) fasteners which attach said clamp plate against said seat elements or back elements.

17. The booth seat of claim 16 wherein said clamp plate edges are angled and positioned such that when said clamp plate is attached to said adjacent seat or back elements said seat or back elements are pulled together.

18. The booth seat of claim 14 including a curved corner section having opposed ends which are oriented 90° apart from one another and which said seat sections can be joined to.

19. The booth seat of claim 18 including an end piece which covers an exposed end of the seat section.

20. The booth seat of claim 18 wherein said corner section includes a corner seat back and a corner seat bottom and a crumb catcher which extends between a bottom edge of said seat back and an inner edge of said seat bottom.

* * * * *